US011060211B2

(12) United States Patent
Tsukamoto et al.

(10) Patent No.: US 11,060,211 B2
(45) **Date of Patent: *Jul. 13, 2021**

(54) TWISTED YARN, OPENED YARN, CARBON FIBER-COVERED TWISTED YARN, AND METHOD FOR MANUFACTURING THESE

(71) Applicant: JAPAN MATEX CO., LTD, Sennan (JP)

(72) Inventors: Katsuro Tsukamoto, Sennan (JP); Hiroaki Tsukamoto, Sennan (JP)

(73) Assignee: JAPAN MATEX CO., LTD, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/923,349

(22) Filed: Jul. 8, 2020

(65) Prior Publication Data

US 2020/0347526 A1 Nov. 5, 2020

Related U.S. Application Data

(63) Continuation of application No. 16/067,678, filed as application No. PCT/JP2017/020374 on May 31, 2017, now Pat. No. 10,844,523.

(30) Foreign Application Priority Data

Aug. 25, 2016 (JP) ..... JP2016-165089

(51) Int. Cl.
*D02G 3/06* (2006.01)
*D02G 3/38* (2006.01)
(Continued)

(52) U.S. Cl.
CPC ..... *D02G 3/06* (2013.01); *D02G 3/16* (2013.01); *D02G 3/36* (2013.01); *D02G 3/38* (2013.01);
(Continued)

(58) Field of Classification Search
CPC .. D02G 3/06; D02G 3/16; D02G 3/36; D02G 3/38; D02G 3/402; D06M 11/45; D06M 11/50
See application file for complete search history.

(56) References Cited

U.S. PATENT DOCUMENTS 2,403,317 A * 7/1946 Warren, Jr. ..... D02G 3/08 57/260
2,981,052 A 11/1957 Machenry
(Continued)

FOREIGN PATENT DOCUMENTS

CN 100451405 C 1/2009
EP 1582785 A1 10/2005
(Continued)

OTHER PUBLICATIONS

Supplementary European Search Report for European patent application No. EP 17843146.6 dated Jun. 2, 2020.
(Continued)

*Primary Examiner* — Shaun R Hurley
(74) *Attorney, Agent, or Firm* — Kelly & Kelley, LLP

(57) ABSTRACT

The present invention relates to twisted yarn obtained by twisting a plurality of carbon fiber resins which are slit from a carbon fiber resin tape in which adhesive, alumina sol, and potassium persulfate permeate between a plurality of the carbon fibers spread flatly. An open yarn is obtained by S-twisting and Z-twisting covering yarn around the periphery of the twisted yarn. A carbon fiber covered twisted yarn is obtained by winding the twisted yarn around the periphery of a core material.

6 Claims, 6 Drawing Sheets

(51) Int. Cl.

| | |
|---|---|
| ***D02G 3/16*** | (2006.01) |
| ***D06M 11/45*** | (2006.01) |
| ***D06M 11/50*** | (2006.01) |
| ***D06M 13/10*** | (2006.01) |
| ***D02G 3/36*** | (2006.01) |
| *D02G 3/40* | (2006.01) |

(52) U.S. Cl.
CPC ..... *D06M 11/45* (2013.01); *D06M 11/50* (2013.01); *D06M 13/10* (2013.01); *D02G 3/402* (2013.01)

(56) References Cited

U.S. PATENT DOCUMENTS

| | | | | |
|---|---|---|---|---|
| 3,327,468 | A | 6/1967 | Page | |
| 3,402,548 | A * | 9/1968 | Wininger, Jr. ..... | B29D 7/00 428/136 |
| 3,422,615 | A * | 1/1969 | Norman, Jr. ..... | D03D 27/00 428/92 |
| 3,608,298 | A | 9/1971 | Schoots | |
| 3,680,303 | A | 8/1972 | Kim | |
| 3,791,129 | A * | 2/1974 | Shuford ..... | D07B 5/00 57/260 |
| 4,697,407 | A | 10/1987 | Wasserman | |
| 5,487,512 | A | 1/1996 | Nojiri et al. | |
| 5,927,060 | A | 7/1999 | Watson | |
| 6,303,078 | B1 * | 10/2001 | Shimizu ..... | D06M 16/00 422/8 |
| 7,255,302 | B2 | 8/2007 | Shearer et al. | |
| 8,250,845 | B2 | 8/2012 | Kimura et al. | |
| 8,616,101 | B2 | 12/2013 | Neuland et al. | |
| 8,844,255 | B2 * | 9/2014 | Ban ..... | D02G 3/446 57/31 |
| 2002/0069635 | A1 | 6/2002 | Tsukamoto | |
| 2005/0218604 | A1 | 10/2005 | Shimizu et al. | |
| 2010/0224309 | A1 | 9/2010 | Tashiro et al. | |
| 2011/0192132 | A1 | 8/2011 | Kimura et al. | |
| 2016/0194482 | A1 | 7/2016 | Humfeld et al. | |
| 2017/0080644 | A1 | 3/2017 | Perera | |
| 2017/0233611 | A1 | 8/2017 | Tsukamoto et al. | |
| 2018/0056325 | A1 | 3/2018 | Tsukamoto et al. | |
| 2019/0169770 | A1 * | 6/2019 | Tsukamoto ..... | D06M 11/50 |
| 2019/0233984 | A1 | 8/2019 | Tsukamoto et al. | |
| 2019/0275705 | A1 | 9/2019 | Johnston, VII | |

FOREIGN PATENT DOCUMENTS

| | | | |
|---|---|---|---|
| GB | 2477531 | A | 8/2011 |
| GB | 2482475 | A | 2/2012 |
| JP | 2761017 | B2 | 6/1998 |
| JP | 2002-129440 | A | 5/2002 |
| JP | 2003-065441 | A | 3/2003 |
| KR | 10-2006-0044879 | A | 5/2006 |
| KR | 10-2008-0109883 | A | 12/2008 |
| WO | 2016/068210 | A1 | 5/2016 |
| WO | 2016068210 | A1 | 4/2017 |

OTHER PUBLICATIONS

Office Action for Chinese patent application No. 20178005907.9 dated Jul. 13, 2020.

Office Action for Chinese patent application No. 20178005907.9 dated Feb. 23, 2021.

* cited by examiner

TWISTED YARN, OPENED YARN, CARBON FIBER-COVERED TWISTED YARN, AND METHOD FOR MANUFACTURING THESE

This application is a continuation of U.S. application Ser. No. 16/067,678, filed Jul. 2, 2018.

TECHNICAL FIELD

The present invention relates to twisted yarn obtained by twisting a plurality of carbon fiber resins which are slit from a carbon fiber resin tape, open yarn obtained by S-twisting and Z-twisting covering yarn around the periphery of the twisted yarn, carbon fiber covered twisted yarn obtained by winding the twisted yarn around the periphery of a core material, and methods for manufacturing thereof.

BACKGROUND

There are a wide variety of carbon fibers ranging from 1K to 64K and their use is chosen depending on their application.

For example, 12K consists of a bundle of 12,000 carbon fibers and is configured to twist them into one bundle by sizing (pasting).

International Publication No. 2016/068210 (PCT/JP2015/080450) by this applicant discloses a method for opening these carbon fiber bundles and manufacturing a resin tape by use of an opening apparatus, etc. for these carbon fiber bundles.

The carbon fiber resin tape is used for a variety of products utilizing a double-sided adhesive tape, etc. since it has high tensile strength, is lightweight and tight, and the inventors attempted to utilize this carbon fiber resin tape for yarn which is required for high tensile strength.

PRIOR ART DOCUMENT

Patent document

[Patent document 1] International Publication No. 2016/068210

SUMMARY

Problems to be Solved by the Invention

As a result of trial and error by the applicant to manufacture such yarn as described above, in the present invention, twisted yarn obtained by twisting a plurality of carbon fiber resins which are slit from a carbon fiber resin tape and open yarn which is strong against bending and tensile force and can be used for a variety of application by S-twisting and Z-twisting covering yarn around twisted yarn comprised of a carbon fiber resin tape, and a method for manufacturing the twisted yarn the open yarn have been developed.

Means for Solving the Problem

One embodiment of the present invention relates to twisted yarn obtained by twisting carbon fiber resins which are slit from a carbon fiber resin tape and open yarn obtained by S-twisting and Z-twisting covering yarn around the periphery of the twisted yarn, more specifically, twisted yarn and open yarn obtained by S-twisting and Z-twisting covering yarn around the twisted yarn.

Other embodiment of the present invention relates to carbon fiber covered twisted yarn obtained by winding carbon fiber resins which are slit from a carbon fiber resin tape around a core material.

The present invention relates to a method for manufacturing twisted yarn, the method comprising:

a 1st step of immersing a carbon fiber bundle having a plurality of carbon fibers into reduced water having a negative oxidation-reduction potential to spread the carbon fiber bundle flat;

a 2nd step of immersing the carbon fiber bundle into either adhesive solution containing adhesive, alumina sol, and potassium persulfate or adhesive solution containing adhesive, alumina sol, and benzoyl after the 1st step;

a 3rd step of drying the carbon fiber bundle to manufacture a carbon fiber resin tape after the 2nd step; and a 4th step of slitting the carbon fiber resin tape and twisting a plurality of the slit carbon fiber resins at 15-80 times/m to form twisted yarn, and the present invention further relates to a method for manufacturing open yarn, the method comprising:

a 5th step of S-twisting and Z-twisting covering yarn around the twisted yarn.

The present invention relates to a method for manufacturing carbon fiber covered twisted yarn, the method comprising:

a 1st step of immersing a carbon fiber bundle having a plurality of carbon fibers into reduced water having a negative oxidation-reduction potential to spread the carbon fiber bundle flat;

a 2nd step of immersing the carbon fiber bundle into either adhesive solution containing adhesive, alumina sol, and potassium persulfate or adhesive solution containing adhesive, alumina sol, and benzoyl after the 1st step;

a 3rd step of drying the carbon fiber bundle to manufacture a carbon fiber resin tape after the 2nd step;

a 4th step of slitting the carbon fiber resin tape and twisting a plurality of the slit carbon fiber resins at 15-80 times/m to form twisted yarn, and a 5th step of S-twisting one covering yarn and Z-twisting the other covering yarn around the periphery of a core material of twisted yarn comprising a carbon fiber resin tape.

The present invention relates to a method for manufacturing resin-coated yarn, the method comprising:

cutting open yarn or carbon fiber covered twisted yarn; and compounding the cut open yarn or carbon fiber covered twisted yarn with resins and extruding it.

Effects of the Invention

One embodiment of the present invention is twisted yarn obtained by twisting a plurality of carbon fiber resins which are slit from a carbon fiber resin tape and open yarn obtained by S-twisting and Z-twisting covering yarn around the periphery of the twisted yarn, which are strong against bending and tensile force and can be used for a variety of application.

Moreover, in other embodiment, carbon fiber covered twisted yarn which is lightweight and has as much as 4 times strength as a stainless steel has can be obtained by winding twisted yarn obtained by twisting carbon fiber resins which are slit from a carbon fiber resin tape around a core material such as yarn.

In the present invention, covering yarn may be selected from one or more of nylon fiber, polytetrafluoroethylene, aramid fiber, stainless steel material, and Inconel (registered trademark) wire.

In the present invention, Kepler (registered trademark), Teflon (registered trademark), aramid fiber, Toughcleist (registered trademark), etc. may be used as yarn of a core material around which a plurality of carbon fiber resins which are slit from a carbon fiber resin tape are wound.

According to the method for manufacturing twisted yarn comprising a carbon fiber resin tape of the present invention, the carbon fiber resin tape manufactured through the 1st step to the 3rd step has high adhesive strength when adhesive is used, since there are dried adhesive, alumina sol, and potassium persulfate on the surface of the carbon fibers and in a gap between the carbon fibers. Moreover, even when a plurality of carbon fiber resin tapes are laminated with adhesive to form a three-dimensional shape, it is not necessary to pressurize at high pressure. Also when heating, high adhesive strength can be obtained with heating at 100° C. or lower.

The carbon fiber resin tapes manufactured through the 3rd step are slit during the 4th step and a plurality of the slit carbon fiber resins are twisted at 15-80 times/m to manufacture twisted yarn.

This twisted yarn is tight and thus can be used for a variety of application.

Furthermore, in the 5th step, one covering yarn is S-twisted and the other covering yarn is Z-twisted around the periphery of the twisted yarn manufactured through the 4th step of the present invention to manufacture open yarn.

In the 5th step, the twisted yarn is covered with two pieces of covering yarn, allowing for manufacture of open yarn with high durability against bending and tension.

In the method for manufacturing open yarn of the present invention, covering yarn is wound around twisted yarn at 4-6 mm-wide equal interval, allowing for manufacturing of yarn with more strong bending resistance.

In the present invention, stronger carbon fiber covered twisted yarn compared with the conventional yarn can be obtained by winding twisted yarn obtained by twisting carbon fiber resins which are slit from a carbon fiber resin tape around a core material such as yarn.

Moreover, in the present invention, a low-melting thermoplastic resin is covered over the outer peripheral surface of twisted yarn, improving bonding strength between carbon fiber resins forming the twisted yarn.

Furthermore, in the present invention, a low-melting thermoplastic resin is covered over the outer peripheral surface of open yarn (specifically, the outer peripheral surface of layer around which covering yarn is wound), improving bonding strength between carbon fiber resins forming the twisted yarn as well as bonding strength between the twisted yarn and the covering yarn.

Also, in the present invention, a low-melting thermoplastic resin is covered over the outer peripheral surface of carbon fiber covered twisted yarn (specifically, the outer peripheral surface of layer around which carbon fiber resins are wound), improving bonding strength between the carbon fiber resins.

In addition, if knitted fabric or woven fabric is manufactured with any of twisted yarn, open yarn, and carbon fiber covered twisted yarn above and then heated, the low-melting thermoplastic resins covering them are melted and the adjacent low-melting thermoplastic resins bond each other. As such, it becomes possible to easily process the knitted fabric or woven fabric into a merged article.

Also, in the present invention, the step for covering twisted yarn, open yarn, and carbon fiber covered twisted yarn with low-melting thermoplastic resins can be performed by extruding the low-melting thermoplastic resins together with these yarn from a nozzle while contacting the resins with the outer peripheral surfaces of these yarn. As such, it becomes possible to improve strength of twisted yarn, open yarn, and carbon fiber covered twisted yarn above and continuously perform coating with the low-melting thermoplastic resins.

DESCRIPTION OF EMBODIMENTS

1st Embodiment

Figure 1:
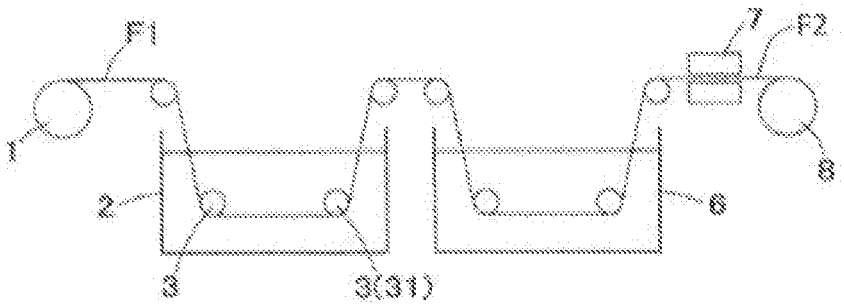
FIG. 1 is a schematic view of an apparatus for manufacturing a carbon fiber resin tape for use in a method for manufacturing the carbon fiber resin tape according to the 1st embodiment of the present invention.

Described hereinafter are the 1st embodiment of the present invention, which are twisted yarn obtained by twisting a plurality of carbon fiber resins which are slit (cut) from a carbon fiber resin tape, open yarn obtained by S-twisting and Z-twisting covering yarn around the periphery of the twisted yarn, and a method for manufacturing thereof, and the other embodiment, which is carbon fiber covered twisted yarn obtained by winding twisted yarn obtained by twisting the carbon fiber resins which are slit from the carbon fiber resin tape around yarn of a core material.

The carbon fiber resin tape used in the present invention is one manufactured with a method described in WO2016/068210 (PCT/JP2015/080450) applied by this applicant.

Twisted yarn is manufactured by twisting a plurality of carbon fiber resins which are slit from the carbon fiber resin tape.

Covering yarn may be selected from one or more of nylon fiber such as nylon 6 or nylon 66, polytetrafluoroethylene, aramid fiber, stainless steel material such as SUS316L, or Inconel (registered trademark) wire. Inconel is an alloy which comprises nickel mainly and contains other components such as chromium, iron and carbon, and also a heat and corrosion resistant alloy used in a variety of application such as a processing material or a casting material.

These can be optionally selected depending on the conditions of use, temperature, chemical resistance, pressure and repetition frequency of open yarn.

The diameter of the covering yarn used is preferably 0.03-0.12 mm, the diameter of the yarn made of inorganic or organic materials is preferably 0.03 mm, and the diameter of the metal yarn is preferably 0.08 mm.

The covering yarn is S- and Z-twisted around the twisted yarn comprising carbon fiber resin tape in a X shape, and protected against bending.

In this case, the S-twisted covering yarn and Z-twisted covering yarn are wound to be crossed into a X shape at equal intervals, and the interval between each intersection point crossing into X shape is preferably 4 mm-6 mm.

The interval of 4 mm or less causes waste material, and increases the weight and cost of the material. The interval of 6 mm or more breaks the material when bended by 180°, and thus, the material cannot be formed as yarn and becomes bump shape and unstable.

Also, the diameter of the open yarn manufactured is preferably 0.15 mm to 2.5 mm.

Other embodiment of the present invention is carbon fiber covered twisted yarn obtained by winding carbon fiber resins which are slit from the carbon fiber resin tape around yarn of a core material.

The carbon fiber resin may be single-wound, double-wound with S-twisting and Z-twisting, or bias-wound at 45° or 60°.

Yarn may be tightened by adding carbon fiber and resin to the core material, and provided with a variety of resistance by applying an infrared inhibitor etc.

A method for manufacturing a carbon fiber resin tape used for open yarn of this embodiment comprises a 1st step of immersing a carbon fiber bundle comprising a plurality of carbon fibers into a reduced water having a negative oxidation-reduction potential to spread the carbon fiber bundle flat, a 2nd step of immersing the carbon fiber bundle into adhesive solution containing adhesive, alumina sol, and potassium persulfate after the 1st step, and a 3rd step of drying the above-mentioned carbon fiber bundle after the 2nd step.

In this embodiment, the carbon fiber bundle comprising a plurality of carbon fibers is referred to as a carbon fiber resin tape after drying in the 3rd step.

The method also comprises a 4th step of slitting the carbon fiber resin tape and twisting a plurality of slit carbon fiber resins at 15-80 times/m to form twisted yarn after the 3rd step.

The method further comprises a 5th step of S-twisting one covering yarn and Z-twisting the other covering yarn around the periphery of the twisted yarn to manufacture open yarn.

FIG. 1 shows an apparatus for manufacturing a carbon fiber resin tape used for the method for manufacturing the carbon fiber resin tape of the present invention. The apparatus for manufacturing a carbon fiber resin tape is equipped with a yarn-feeding roller 1 feeding a carbon fiber bundle F1, and a take-up roller 8 taking up the formed carbon fiber resin tape F2.

The apparatus for manufacturing a carbon fiber resin tape is equipped with a first tub 2 and second tub 6 immersing the carbon fiber bundle F1 between the yarn-feeding roller 1 and the take-up roller 8 in turn, and a dryer 7 drying the carbon fiber bundle F1 between the second tub 6 and the take-up roller 8. The apparatus for manufacturing a carbon fiber resin tape is also suitably equipped with a roller feeding the carbon fiber bundle F1 between the yarn-feeding roller 1 and the take-up roller 8.

The first tub 2 stores reduced water having negative oxidation-reduction potential. The second tub 6 stores adhesive solution containing adhesive, alumina sol and potassium persulfate.

Each step of the method for manufacturing the carbon fiber resin tape F2 of this embodiment is described below.

1st Step

As illustrated in FIG. 1, the carbon fiber bundle F1 is continuously fed from the yarn-feeding roller 1, and immersed into water stored in the first tub 2 for the predetermined time.

The examples of the carbon fiber bundle F1 include non-twisted carbon fibers of 3K (namely, a bundle of 3000 non-twisted carbon fibers), 6K (a bundle of 6000 non-twisted carbon fibers), 12K (a bundle of 12000 non-twisted carbon fibers), etc. Both acrylic and pitch carbon fiber can be applied.

In the present invention, water stored in the first tub 2 is a reduced water having negative oxidation-reduction potential.

Although normal water has a positive oxidation-reduction potential (in the case of tap water: about +400 to +600 mV), the reduced water has a negative oxidation-reduction potential, small water molecule cluster and good penetrating force.

The carbon fiber bundle F1 is immersed into such reduced water to be naturally spread without exerting a physical external force such as ultrasonic wave.

The oxidation-reduction potential of the reduced water used in the present invention is preferably −800 mV or lower.

Using such reduced water with low oxidation-reduction potential, it becomes possible to securely spread a carbon fiber constituting the carbon fiber bundle F1 flat in a short period of time to provide a belt-like plain weave fiber bundle. Also, the obtained belt-like plain weave fiber bundle becomes difficult to return to its original state.

The method of manufacturing reduced water used in the present invention illustrates, but not limited to, e.g., the following methods.

1. Gas Bubbling Method

Bubbling nitrogen gas, argon gas or hydrogen gas reduces oxygen concentration and oxidation-reduction potential in water.

2. Method With the Addition of Hydrazine

Adding hydrazine reduces oxygen concentration and oxidation-reduction potential in water.

3. Method With Electrolysis (a) Electrolysis of water is performed by applying a high frequency voltage having asymmetric positive and negative wave crest value and/or duty ratio, and then oxidation-reduction potential is reduced.

(b) An electrode is made of one ground electrode (cathode), and two special shaped electrodes (rhombus shaped net-like electrode or hexagonal shaped net-like electrode) consisting of Pt and Ti in which an anode and cathode change alternately, electrolysis of water is performed by applying a high frequency voltage, and then oxidation-reduction potential is reduced.

In the present invention, the reduced water obtained by especially the method of "3 (b)" is preferably used.

This is because the method of "3 (b)" can provide reduced water more easily and securely which has low oxidation-reduction potential (−800 mV or lower) and negative oxidation-reduction potential can be maintained for a long time, as compared with other methods.

An apparatus for performing the method of "3 (b)" is disclosed in Japanese Patent Publication No. 2000-239456 by the applicant, and the method can be performed based on the content of the disclosure.

Figure 2:
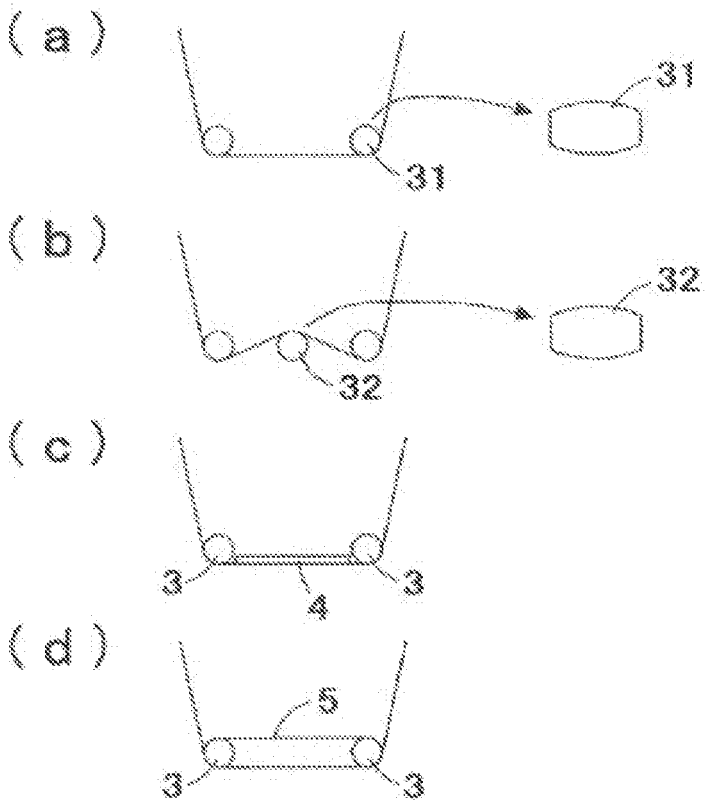
FIG. 2 is a view showing examples of configurations for helping opening action, where FIG. 2(*a*) shows a configuration that opening action is provided to a second roller 31 of two conveying rollers 3 supporting and conveying the carbon fiber bundle F1 in the first tub 2, FIG. 2(*b*) shows a configuration that opening action is provided to the second and following rollers (the second roller 32 in the figure) by providing three or more conveying rollers 3 (in the figure, three rollers) in the first tub 2 so that the carbon fiber bundle F1 is configured to be conveyed while being bent, FIG. 2(*c*) shows a configuration that the fiber becomes easier to spread flat by providing a flat plate 4 between the conveying rollers 3 supporting and conveying the carbon fiber bundle F1 in the first tub 2, and conveying the bundle F1 along the surface of the flat plate 4, and FIG. 4(*d*) shows a configuration that the fiber becomes easier to spread flat by winding a flat belt 5 around the conveying rollers 3 supporting and conveying the carbon fiber bundle F1 in the first tub 2, and conveying the bundle F1 along the surface of the flat belt 5.

In the present invention, the carbon fiber bundle F1 can be spread (opened) naturally without exerting physical external force by immersing the bundle into the above-mentioned reduced water, but the configuration as illustrated in FIG. 2 may be adopted in order to help the opening action.

(a) in FIG. 2 shows a configuration that opening action is provided to a second roller 31 of two conveying rollers 3 supporting and conveying the carbon fiber bundle F1 in the first tub 2.

Specifically, the configuration is that the fiber becomes easier to spread along the surface of the second roller 31 by swelling the cross-sectional (cross-section along rotation axis) shape of the second roller 31 toward the center from both sides, as shown by the arrow in the figure.

(b) in FIG. 2 shows a configuration that opening action is provided to the second and following rollers (the second roller 32 in the figure) by providing three or more conveying rollers 3 (in the figure, three rollers) in the first tub 2 so that the carbon fiber bundle F1 is configured to be conveyed while being bent.

Specifically, the configuration is that the fiber becomes easier to spread along the surface of the roller 32 by forming the roller 32 into the same cross-section as that of (a) in FIG. 2.

(c) in FIG. 2 shows a configuration that the fiber becomes easier to spread flat by providing a flat plate 4 between the conveying rollers 3 supporting and conveying the carbon fiber bundle F1 in the first tub 2, and conveying the bundle F1 along the surface of the flat plate 4.

(d) in FIG. 2 shows a configuration that the fiber becomes easier to spread flat by winding a flat belt 5 around the conveying rollers 3 supporting and conveying the carbon fiber bundle F1 in the first tub 2, and conveying the bundle F1 along the surface of the flat belt 5.

2nd Step

The carbon fiber (plain weave fiber bundle) which is spread flat by being immersed into the reduced water through the first tub 2 is taken from the first tub 2, and then, continuously introduced into the second tub 6.

The second tub 6 stores an adhesive solution containing adhesive, alumina sol and potassium persulfate, and the plain weave fiber bundle obtained by being immersed into the reduced water is immersed into the adhesive solution in the second tub 6.

In the present invention, benzoyl may be used instead of potassium persulfate, and the same applies to the following description.

The adhesive has a hydrophilic group, and preferably includes water-soluble paste like laundry starch, PVA (polyvinyl alcohol), PTFE dispersion, graphite nano dispersion, glycol, water-soluble clay dispersion, starch paste, urethane-, silicon-, RFL-, epoxy-, imide-dispersion solution, or organic- or inorganic-material containing dispersion solution which contains OH-group.

If the concentration of the adhesive is lower than the predetermined range, the flat spread carbon fiber bundle F1 can return to its original state. Also, if the concentration of the adhesive is higher than the predetermined range, the adhesive can be difficult to permeate into the carbon fiber bundle F1.

If the adhesive is PVA, the concentration is preferably 0.5-30 wt %.

The concentration of alumina sol is preferably 0.5-16.7 wt %. If the concentration of alumina sol is lower than the above-mentioned lower limit, the adhesive strength of the carbon fiber resin tape can decrease. Also, even if the concentration of alumina sol is higher than the above-mentioned upper limit, the adhesive strength of the carbon fiber resin tape is difficult to increase furthermore.

The ratio of concentration of PVA to that of alumina sol is preferably 3:1. The concentration of potassium persulfate is preferably 0.5-10 wt %.

The alumina shape of alumina sol may be any of plate-, pillar-, fibrous-, or hexagonal plate-shape.

If the alumina sol has a fibrous-shape, the alumina fiber is a fibrous crystal of alumina, and specifically includes an alumina fiber formed with non-hydrate of alumina, a hydrated alumina-fiber formed with alumina containing hydrate, etc.

The crystal system of alumina fiber may be any of amorphous, boehmite, pseudo-boehmite, etc. The boehmite is a crystal of hydrated alumina represented by composition formula: $Al_2O_3.nH_2O$. The crystal system of alumina fiber can be adjusted with, for example, the type of the hydrolytic aluminium compound described below, and hydrolysis condition or deflocculating condition thereof. The crystal system of alumina fiber can be found using X-ray diffractometer (for example, a trade name "Mac. Sci. MXP-18" manufactured by MAC SIENCE, INC.).

In this way, a plain weave fiber bundle is immersed into the mixed solution containing adhesive, alumina sol, and potassium persulfate so that the mixed solution containing adhesive, alumina sol, and potassium persulfate permeate between the spread fibers.

Figure 3:
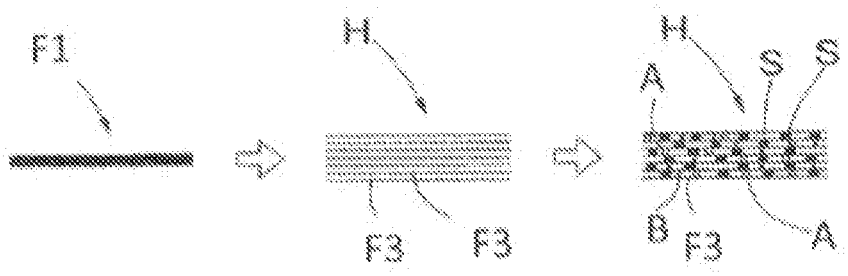
FIG. 3 is a view schematically showing transition of a carbon fiber bundle form in the manufacturing method according to the 1st embodiment of the present invention.

FIG. 3 shows schematically the above-mentioned steps, wherein a carbon fiber bundle F1 comprising a plurality of carbon fibers is immersed into reduced water to form a plain weave fiber bundle H in which the carbon fiber F3 spreads flat, and the plain weave fiber bundle H is immersed into the solution containing adhesive, alumina sol, and potassium persulfate so that adhesive S, alumina sol A, and potassium persulfate B permeate between the carbon fiber F3.

In the present invention, the above-mentioned reduced water can be used as a solvent which melts adhesive so that the penetrating force of the adhesive can be increased.

In the present invention, it is also possible to adopt a method for spraying a solution containing adhesive to the carbon fiber (plain weave fiber bundle) spread flat by being immersed into reduced water without forming the second tub 6.

3rd Step

The spread carbon fiber bundle F1 after being immersed into the solution containing adhesive and alumina sol is taken out from the second tub 6, subsequently provided to the dryer 7 and dried.

The type of the dryer 7 may be, but not limited to, a heater heating apparatus, a warm air heating apparatus, or a heating apparatus using far-infrared rays.

However, in the method of the present invention, it is not necessary to provide the dryer 7 and natural drying may be performed.

In addition, after the 3rd step, the carbon fiber resin tape F2 may further be washed in water to remove excessive adhesive and dried.

The peeling strength is improved by removing excessive impurities and leaving only the required OH—.

The carbon fiber bundle F1 after being immersed into the solution containing adhesive is dried so that the adhesive, alumina sol, and potassium persulfate permeated between spread fibers are solidified.

In this way, the fibers are solidified in a flat spread state by using adhesive to obtain the carbon fiber resin tape F2 which does not return to its original state even with the lapse of time and has high mechanical strength.

The carbon fiber resin tape F2, after passing the dryer 7 and the adhesive was solidified, is taken up by the take-up roller 8, thereby completing the manufacture of the carbon fiber resin tape F2.

As explained above, the method of the present invention enables the manufacture of the belt-like carbon fiber resin tape F2 by spreading fibers flat without exerting physical external force.

However, the method of the present invention does not completely exclude the exertion of physical external force and may be combined with the traditional method for exerting physical external force.

For example, it is also possible to adopt a method for installing an ultrasonic generator in the above-mentioned first tub 2 and applying ultrasonic waves to the carbon fiber bundle F1 immersed into reduced water.

In this case, it is possible to obtain an effect of efficiently manufacturing a fully spread belt-like plain weave fiber bundle while securely preventing damage to the fiber, because sufficient opening can be obtained by the opening action of reduced water even if the output of ultrasonic waves is reduced.

4th Step

The carbon fiber resin tape F2 manufactured by the above-mentioned 3rd step is slit.

Slitting is performed more than one time with a slitter machine etc. to slit (cut) the carbon fiber resin tape F2 to any width or length.

After being slit, a plurality of carbon fiber resins are twisted with a yarn twisting machine etc. to form twisted yarn P. Twisting is preferably performed at 15 to 80 times/m.

5th Step

Two covering yarn C is wound around the periphery of the twisted yarn P after being twisted in the above-mentioned 4th step.

Figure 4:
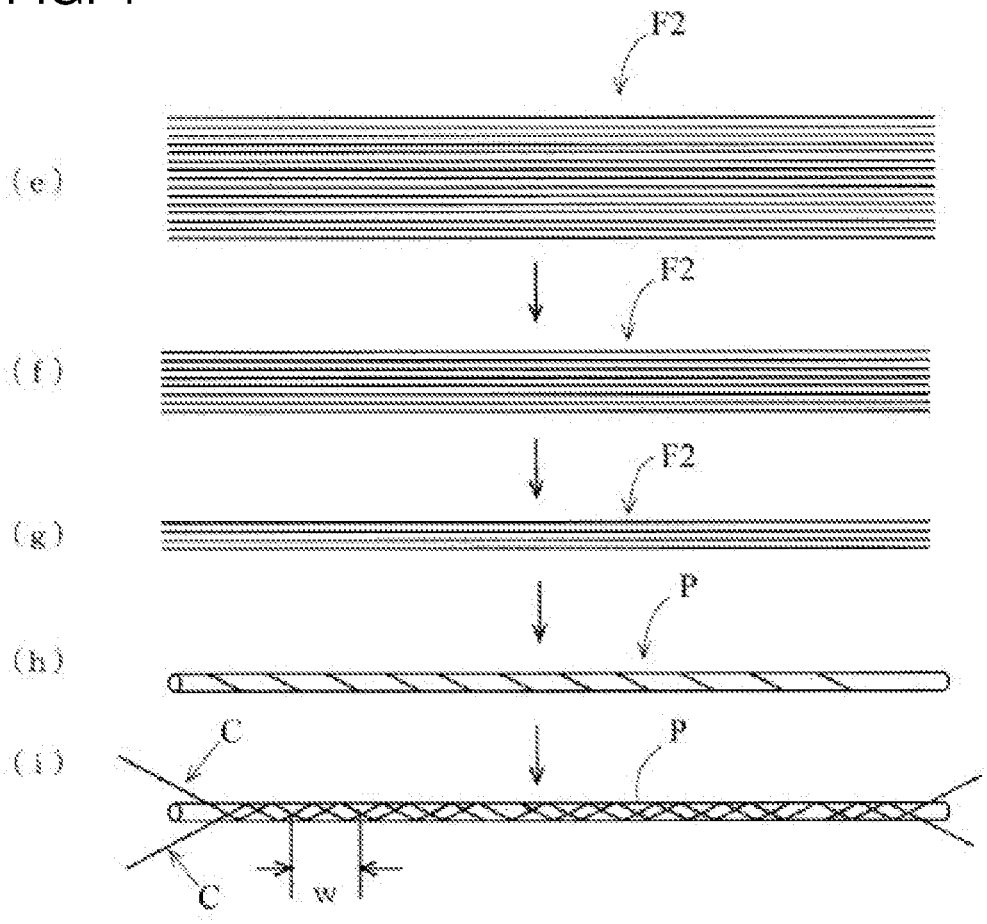
FIG. 4 is a view schematically showing steps of forming the carbon fiber resin tapes according to the 1st embodiment of the present invention into open yarn.

At this time, one covering yarn C is S-twisted and the other is Z-twisted into X-shape at equal intervals (See (i) in FIG. 4).

At this time, it is wound at wide (w) having the interval of 4 mm to 6 mm, since the interval of 4 mm or less causes waste material and increases the weight and cost of the material, and the interval of 6 mm or more breaks the material when bent by 180 degrees and the material cannot be formed as yarn and becomes bump shape and unstable.

5'th Step

Although the above-mentioned 5th step uses the twisted yarn twisted in the 4th step as a core material and normal yarn as covering yarn, the carbon fiber covered twisted yarn may be manufactured by using normal yarn as a core material and the twisted yarn twisted in the 4th step as covering yarn.

The open yarn manufactured in the 5th step or the carbon fiber covered twisted yarn manufactured in the 5'th step may be cut, compounded with a resin, and extruded to manufacture resin-coated yarn.

Example 1

12K carbon fiber resin tape is manufactured via a 1st step of immersing a carbon fiber bundle comprising 12K carbon fibers into reduced water having negative oxidation-reduction potential to spread the carbon fiber bundle flat, a 2nd step of immersing the carbon fiber bundle into adhesive solution containing adhesive, alumina sol, and potassium persulfate after the 1st step, and a 3rd step of drying the carbon fiber bundle to manufacture a carbon fiber resin tape after the 2nd step.

12K carbon fiber resin tape is slit into 6K, the 6K carbon fiber resin tape is twisted at 15 to 80 times/m to form twisted yarn. Then, one covering yarn is S-twisted and the other is Z-twisted to manufacture open yarn.

Example 2

12K carbon fiber resin tape is manufactured via a 1st step of immersing a carbon fiber bundle comprising 12K carbon fibers into reduced water having negative oxidation-reduction potential to spread the carbon fiber bundle flat, a 2nd step of immersing the carbon fiber bundle into adhesive solution containing adhesive, alumina sol, and potassium persulfate after the 1st step, and a 3rd step of drying the carbon fiber bundle to manufacture a carbon fiber resin tape after the 2nd step.

The 12K carbon fiber resin tape is slit into 6K, and the 6K carbon fiber resin is further slit to form 3K carbon fiber resin.

The 3K carbon fiber resin tape is twisted at 15 to 80 times/m to form twisted yarn, and one covering yarn is S-twisted and the other is Z-twisted to manufacture open yarn.

Example 3

12K carbon fiber resin tape is manufactured via a 1st step of immersing a carbon fiber bundle comprising 12K carbon fibers into reduced water having negative oxidation-reduction potential to spread the carbon fiber bundle flat, a 2nd step of immersing the carbon fiber bundle into adhesive solution containing adhesive, alumina sol, and potassium persulfate after the 1st step, and a 3rd step of drying the carbon fiber bundle to manufacture a carbon fiber resin tape after the 2nd step.

12K carbon fiber resin tape is slit into 6K, the 6K carbon fiber resin is twisted at 15 to 80 times/m to form twisted yarn. Then, aramid fibers are used as a core material, one covering yarn is S-twisted and the other is Z-twisted around the core material to manufacture carbon fiber covered twisted yarn.

The open yarn and the carbon fiber covered twisted yarn manufactured in the above-mentioned examples were lighter than those using glass and ceramics as a core material, and has as much as 4 times strength as a stainless steel.

2nd Embodiment

Figure 5:
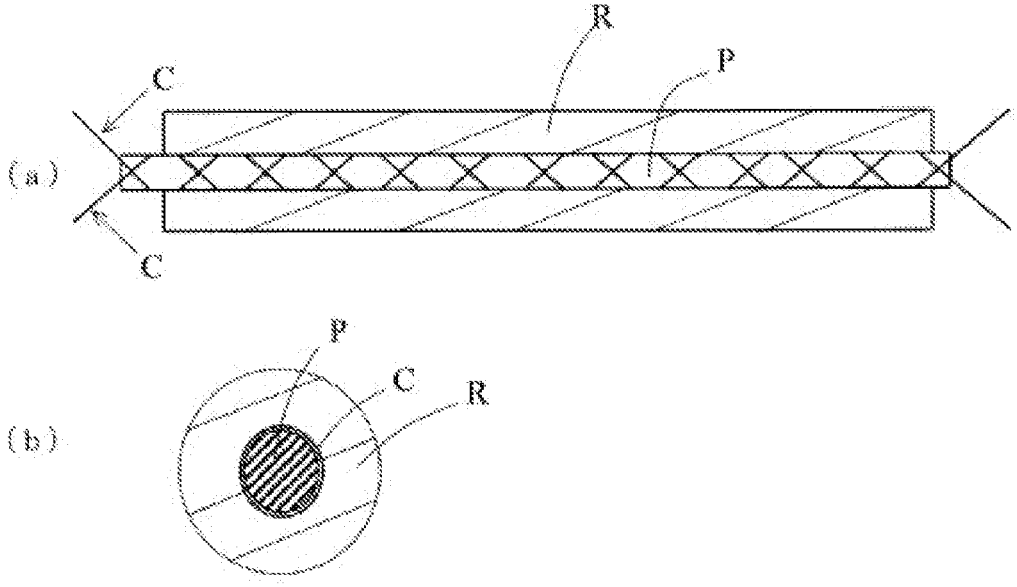
FIG. 5 is a view showing a configuration of open yarn covered with the low-melting thermoplastic resin according to the 2nd embodiment of the present invention, where (a) is a longitudinal cross-sectional view of open yarn and (b) is a transverse cross-sectional view of open yarn.

Next, the 2nd embodiment of the present invention which is open yarn covered with low-melting thermoplastic resin is explained with the reference to FIG. 5.

The open yarn shown in FIG. 5 (a) and (b) has a structure comprising twisted yarn P obtained by twisting carbon fiber resins which are slit from a carbon fiber resin tape, covering yarn C obtained by S-twisting and Z-twisting around the periphery of the twisted yarn P, and low-melting thermoplastic resin R covered over the outer peripheral surface of the layer composed of the S-twisted and Z-twisted covering yarn C.

This open yarn is manufactured in the same as the method for manufacturing the open yarn of the 1st embodiment, the method comprising a 1st step of immersing a carbon fiber bundle comprising a plurality of carbon fibers into reduced water having negative oxidation-reduction potential to spread the carbon fiber bundle flat, a 2nd step of immersing the carbon fiber bundle into either adhesive solution containing adhesive, alumina sol, and potassium persulfate or adhesive solution containing adhesive, alumina sol and benzoyl after the 1st step, a 3rd step of drying the carbon fiber bundle to manufacture a carbon fiber resin tape after the 2nd step, a 4th step of slitting the carbon fiber resin tape and twisting the plurality of slit carbon fiber resins at 15 to 80 times/m to form twisted yarn P, and a 5th step of S-twisting covering yarn C and Z-twisting the other covering yarn around the periphery of the twisted yarn P comprising the carbon fiber resin tape.

In addition, it is possible to manufacture the open yarn shown in (a) and (b) in FIG. 5 by performing a step of covering a low-melting thermoplastic resin R over the outer peripheral surface of a layer obtained by S-twisting and Z-twisting the covering yarn C, after the 5th step.

The twisted yarn P used for this open yarn is manufactured, for example, by twisting the tape with any width after slitting the opened carbon fiber resin tape (hereinafter, referred to as "open carbon fiber resin tape") in the same way as the twisted yarn of the 1st embodiment.

Alternatively, the twisted yarn P is manufactured by twisting the open carbon fiber resin tape containing non-twisted carbon fibers of 3K (3000 bundles), 6K (6000 bundles), or 12K (12000 bundles) of, without slitting the open carbon fiber resin tape.

The carbon fiber resin tape same as the one of the 1st embodiment may be used in manufacture of the twisted yarn. For example, about 3K to 24K (3000 to 24000 bundles) of regular tow (R/T) is used, and the large tow (L/T) having a K-value larger than 24K (for example, 48K or 64K or more) may also be used.

Continuous twisted yarn P is obtained by twisting such a resin tape at 50 to 60 times/m with a yarn twisting machine.

Covering is performed in order to S-twist and Z-twist covering yarn C comprising nylon 6, 12, and 66 etc. with 20 to 50 μm in diameter around this twisted yarn P (the above-mentioned 5th step). This can provide open yarn having a sedimentary layer of the covering yarn C formed on the outer peripheral surface of the twisted yarn P.

The covering yarn C same as the one of the 1st embodiment is used. For example, yarn made of nylon 6, 12, and 66 with 20 to 50 μm in diameter is used as covering yarn.

A low-melting thermoplastic resin R such as the one made of the same material with the covering yarn (for example, nylon 6, 12, and 66 etc.) is further coated (covered) over the outer peripheral surface of this open yarn (that is, the outer peripheral surface of the sedimentary layer of the covering yarn C) at an uniform thickness of 3 to 10 μm with no unevenness to obtain continuous resin-coated open yarn.

The low-melting thermoplastic resin R is the thermoplastic resin which is melted at the melting point which is same as or lower than the covering yarn, for example, at a low melting point of about 98 to 290° C.

As the low-melting thermoplastic resin R, for example, nylon fibers such as nylon 6, 12, and 66, ABS (Acrylnitrile Butadiene Styrene) resin, PET (Polyethyleneterephthalate), PP (Polypropylene), or RFL resin (resin treated with resorcinol formalin latex) etc. are used.

In the 2nd embodiment, covering the low-melting thermoplastic resin R on the outer peripheral surface of the open yarn (specifically, the outer peripheral surface of a layer around which the covering yarn C is wound) improves the bonding strength between the twisted yarn P and the covering yarn C as well as the bonding strength between the carbon fiber resins forming the twisted yarn P.

Furthermore, when knitted fabrics and woven fabrics manufactured with the above-mentioned open yarn are heated, the low-melting thermoplastic resins covered on the open yarn melt and the adjacent low-melting thermoplastic resins bond with each other. This enables a knitted fabric or a woven fabric to be easily processed into a merged article.

As a method of covering the low-melting thermoplastic resin R on the outer peripheral surface of the laminated layers of the covering yarn C, the traditionally-used various coating methods and apparatus, for example, a continuous extension method etc., are used.

Figure 6:
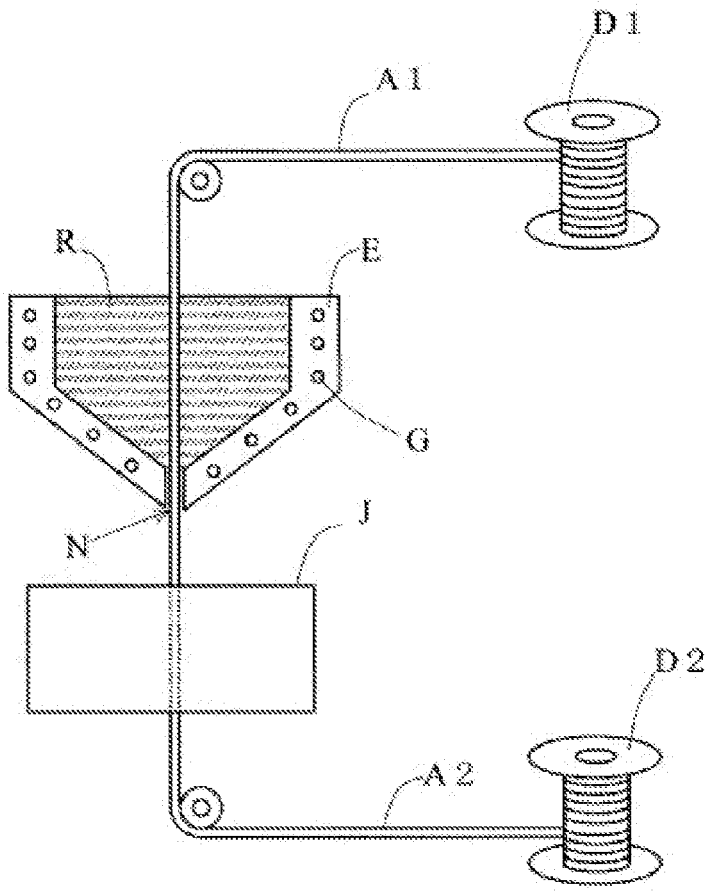
FIG. 6 is a cross-sectional explanatory view showing a configuration of an apparatus for manufacturing open yarn covered with the low-melting thermoplastic resin according to the 2nd embodiment.

For example, in the continuous coating apparatus shown in FIG. 6, a step of covering is performed by extruding the low-melting thermoplastic resin R in a molten state inside a melting furnace E and the open yarn A1 from the nozzle N while contacting the resin R with the outer peripheral surface of the open yarn A1.

Specifically, the open yarn A1 taken up on a first roll D1 before being coated (i.e. the open yarn where the covering yarn C was wound around the twisted yarn P of FIG. 5) is sent out to the melting furnace E. The low-melting thermoplastic resin R molten by heating to about 150-300° C. with a heater G was stored inside the melting furnace E. The outer peripheral surface of the open yarn A1 sent out to the inside of a melting furnace G from above is continuously covered with the molten low-melting thermoplastic resin R, and the open yarn is taken out of the nozzle N provided in the lower part of the melting furnace G. Then, the open yarn A2 covered with the low-melting thermoplastic resin R is cooled to about 10-15° C. by the cooling unit J having a cooling fan, and a water-cooling jacket, etc., to solidify the low-melting thermoplastic resin R. Subsequently, the covered open yarn A2 is taken up on a second roll D2.

In this way, the step of covering the open yarn A1 with the low-melting thermoplastic resin R can be performed by extruding the low-melting thermoplastic resin R and the open yarn A1 from the nozzle N while contacting the outer peripheral surface of the open yarn A1. This allows for improvement of the strength of the covered open yarn A2 and the continuous coating with the low-melting thermoplastic resin R.

The 3rd Embodiment

In the 2nd embodiment the low-melting thermoplastic resin R is covered on the outer peripheral surface of the open yarn in which covering yarn C was wound around the outer peripheral surface of the twisted yarn P, but the present invention is not limited to the embodiment.

Figure 7:
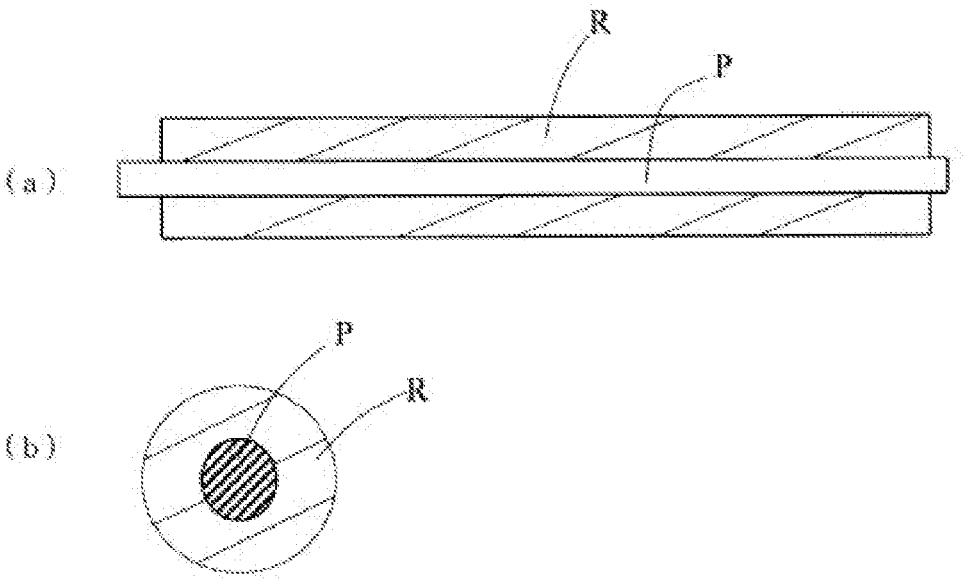
FIG. 7 is a view showing a configuration of twisted yarn covered with the low-melting thermoplastic resin according to the 3rd embodiment of the present invention, where (a) is a longitudinal cross-sectional view of twisted yarn and (b) is a transverse cross-sectional view of twisted yarn.

That is, the 3rd embodiment of the present invention shows the configuration where the low-melting thermoplastic resin R was directly covered on the outer peripheral surface of the twisted yarn P, as shown (a) and (b) in FIG. 7.

This twisted yarn P is manufactured by twisting the opened carbon fiber resin tape in a similar manner as the twisted yarn of the above-mentioned 1st and 2nd embodiments is.

The low-melting thermoplastic resin R is a thermoplastic resin which melts at the low-melting point similar to that of the above-mentioned 2nd embodiment.

When manufacturing such twisted yarn, as in the method of manufacturing the twisted yarn of the above 1st embodiment, firstly the 1st-4th steps are performed: i.e.

the 1st step of immersing the carbon fiber bundle having a plurality of carbon fibers into the reduced water having negative oxidation-reduction potential to spread the carbon fiber bundle flat;

the 2nd step of immersing the carbon fiber bundle into either the adhesive solution comprising adhesive, alumina sol, and potassium persulfate or the adhesive solution comprising the adhesive, alumina sol, and benzoyl, after the 1st step;

the 3rd step of drying the carbon fiber bundle to manufacture the carbon fiber resin tape, after the 2nd step; and the 4th step of slitting the carbon fiber resin tape and twisting a plurality of the slit carbon fiber resins at 15 to 80 times/m to form the twisted yarn P.

Then, after the 4th step, the step of covering the low-melting thermoplastic resin R on the outer peripheral surface of the twisted yarn P is performed. The step of covering may comprise, for example, continuous resin coating using the above-mentioned continuous coating apparatus shown in FIG. 5.

This allows for manufacture of the twisted yarn covered with the low-melting thermoplastic resin R, as shown in (a) and (b) in FIG. 7. In the 3rd embodiment, covering the low-melting thermoplastic resin R on the outer peripheral surface of the twisted yarn P improves the bonding strength between the carbon fiber resins which form the twisted yarn P.

Furthermore, when a knitted fabric and a woven fabric manufactured with the above-mentioned covered twisted yarn are heated, the low-melting thermoplastic resins covered on the twisted yarn melt and the adjacent low-melting thermoplastic resins bond with each other. This enables a knitted fabric or a woven fabric to be easily processed into a merged article.

Moreover, in the 3rd embodiment, the step of covering the twisted yarn P with the low-melting thermoplastic resin R can be performed by extruding the low-melting thermoplastic resin R and the twisted yarn P from the nozzle N while contacting the outer peripheral surface of the twisted yarn P, using the continuous coating apparatus as shown in FIG. 6. This allows for improvement of the strength of these twisted yarn and continuous coating with the low-melting thermoplastic resin R.

The 4th Embodiment

In the 2nd and 3rd embodiments, the low-melting thermoplastic resin is covered on the outer peripheral surface of the twisted yarn and the open yarn without the core material, but the present invention is not limited to the embodiments.

Figure 8:
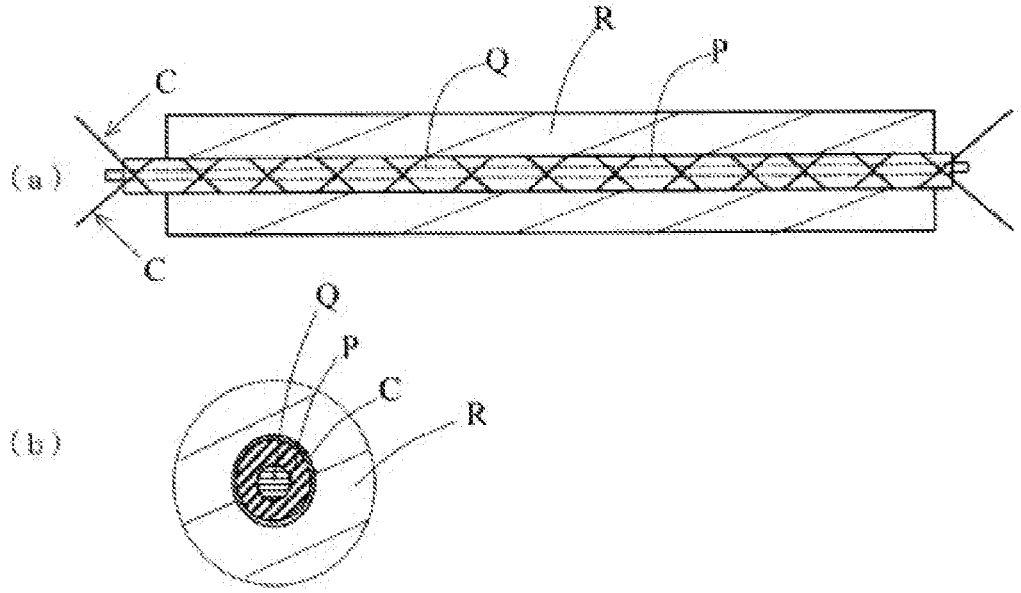
FIG. 8 is a view showing a configuration of carbon fiber covered twisted yarn covered with the low-melting thermoplastic resin according to the 4th embodiment of the present invention, where (a) is a longitudinal cross-sectional view of carbon fiber covered twisted yarn and (b) is a transverse cross-sectional view of carbon fiber covered twisted yarn.

In the 4th embodiment of the present invention, as shown in (a) and (b) in FIG. 8, the carbon fiber covered twisted yarn with the core material Q may be covered with the low-melting thermoplastic resin R.

Specifically, the carbon fiber covered yarn shown in (a) and (b) in FIG. 8 has a configuration where the carbon fiber covered yarn includes the core material Q, the twisted yarn R wound around the outer periphery of the core material Q, the covering yarn C S-twisted and Z-twisted around the outer periphery of the twisted yarn R, and the low-melting thermoplastic resin R covered on the outer peripheral surface of the layer formed by S-twisting and Z-twisting the covering yarn C.

The core material Q is preferably selected from one or more materials among organic or inorganic yarn material, stainless steel material, or the Inconel (registered trademark) wire. Using the selected material allows for easy manufacture of carbon fiber covered twisted yarn with flexibility and desired tensile strength.

The twisted yarn similar to that of the above-mentioned 1st-3rd embodiments is used as the twisted yarn P in the 4th embodiment. Moreover, the covering yarn similar to that of the above-mentioned 1st-3rd embodiments is used as the covering yarn C. Furthermore, the low-melting thermoplastic resin similar to that of the above-mentioned 1st-3rd embodiments is used as the low-melting thermoplastic resin R.

When manufacturing such carbon fiber covered twisted yarn, as in the method of manufacturing the carbon fiber covered twisted yarn in the above-mentioned 1st embodiment, the 1st-5th steps are performed: i.e.

the 1st step of immersing the carbon fiber bundle having a plurality of carbon fibers into the reduced water having negative oxidation-reduction potential to spread the carbon fiber bundle flat;

the 2nd step of immersing the carbon fiber bundle into the adhesive solution comprising adhesive, alumina sol, and potassium persulfate, after the 1st step;

the 3rd step of drying the carbon fiber bundle to manufacture the carbon fiber resin tape, after the 2nd step;

the 4th step of slitting the carbon fiber resin tape and twisting a plurality of the slit carbon fiber resin at 15 to 80 times/m to form the twisted yarn; and the 5th step of S-twisting the one twisted yarn comprising the carbon fiber resin tape and Z-twisting the other around the outer periphery of the core material Q.

Then, after the 5th step, the step of covering the low-melting thermoplastic resin R on the outer peripheral surface of the layer formed by S-twisting and Z-twisting the covering yarn C can be performed to manufacture the carbon fiber covered twisted yarn shown in (a) and (b) in FIG. 8.

As mentioned above, in the carbon fiber covered twisted yarn in the 4th embodiment, covering the low-melting thermoplastic resin R on the outer peripheral surface of the carbon fiber covered twisted yarn improves the bonding strength between the twisted yarn P and the covering yarn C as well as the bonding strength between the carbon fiber resin forming the twisted yarn P.

In addition, as shown in (a) and (b) in FIG. 8, the forth embodiment shows the example of the carbon fiber covered twisted yarn comprising the covering yarn C, but the present invention is not limited to this example. Examples may be included a configuration where the covering yarn C is omitted, i.e. a configuration where the low-melting thermoplastic resin R may be covered on the outer peripheral surface of the twisted yarn P wound around the outer periphery of the core material Q.

Furthermore, when a knitted fabric and a woven fabric manufactured with the carbon fiber covered twisted yarn in the 4th embodiment are heated, the low-melting thermoplastic resins covered on the carbon fiber covered twisted yarn melt and the adjacent low-melting thermoplastic resins bond with each other. This enables a knitted fabric or a woven fabric to be easily processed into a merged article.

In addition, in the present invention, the step of covering the twisted yarn, the open yarn, and the carbon fiber covered twisted yarn with the low-melting thermoplastic resin can be performed by extruding the low-melting thermoplastic resin and these yarn from the nozzle while contacting their outer peripheral surfaces. This allows for improvement of the strength of these twisted yarn, the open yarn, and the carbon fiber covered twisted yarn and continuous coating with the low-melting thermoplastic resin.

Moreover, in the 4th embodiment, the step of covering the carbon fiber covered twisted yarn with the low-melting thermoplastic resin R can be performed by extruding the low-melting thermoplastic resin R and the carbon fiber covered twisted yarn from the nozzle N while contacting the outer peripheral surface of the twisted yarn P, using the continuous coating apparatus as shown in FIG. 6. This allows for improvement of the strength of the carbon fiber covered twisted yarn and the continuous coating with the low-melting thermoplastic resin R.

INDUSTRIAL APPLICABILITY

The twisted yarn, the open yarn, and the carbon fiber covered twisted yarn of the present invention have high tensile strength and bending resistance, and thus, can be widely used for sewing thread, yarn for knitting, fishing nets, fishing lines, landing nets, reinforcement of fishing rods, lashing belts, reinforcement of Vee belts, and the like.

DESCRIPTION OF REFERENCE CHARACTERS

F1 carbon fiber bundle
F2 carbon fiber resin tape
A alumina sol
B potassium persulfate
S adhesive
P twisted yarn
C covering yarn
R low-melting thermoplastic resin
Q core material

The invention claimed is:

1. A carbon fiber covered twisted yarn obtained by twisting a plurality of carbon fiber resins which are slit from a carbon fiber resin tape in which adhesive, alumina sol, and either potassium persulfate or benzoyl, permeate between a plurality of the carbon fibers spread flatly, and winding the carbon fiber covered twisted yarn around the periphery of a core material.

2. The carbon fiber covered twisted yarn according to claim 1, wherein a low-melting thermoplastic resin is covered over an outer peripheral surface thereof.

3. The carbon fiber covered twisted yarn according to claim 2, wherein the core material is selected from one or more of an organic or inorganic yarn material, stainless steel material or wire made of an alloy which comprises nickel mainly and contains other components selected from a group consisting of chromium, iron, and carbon.

4. The carbon fiber covered twisted yarn according to claim 1, wherein the core material includes one or more of an organic or inorganic yarn material, stainless steel material, or an alloy comprising primarily nickel and contains other components being selected from a group consisting of chromium, iron, and carbon.

5. A method for manufacturing the carbon fiber covered twisted yarn described in claim 1, the method comprising;

a 1st step of immersing a carbon fiber bundle having a plurality of carbon fibers into reduced water having a negative oxidation-reduction potential to spread the carbon fiber bundle flat;

a 2nd step of immersing the carbon fiber bundle into adhesive solution containing adhesive, alumina sol, and potassium persulfate after the 1st step;

a 3rd step of drying the carbon fiber bundle to manufacture a carbon fiber resin tape after the 2nd step; and a 4th step of slitting the carbon fiber resin tape and twisting a plurality of the slit carbon fiber resins at 15-80 times/m to form twisted yarn.

6. The method for manufacturing the carbon fiber covered twisted yarn according to claim 5, including the step of extruding a low-melting thermoplastic resin in a molten state together with the carbon fiber covered twisted yarn.

* * * * *